US006117827A

United States Patent [19]

Nagaoka et al.

[11] Patent Number: 6,117,827

[45] Date of Patent: Sep. 12, 2000

[54] BIODEGRADABLE LUBRICANT BASE OIL AND ITS MANUFACTURING PROCESS

[75] Inventors: Shushi Nagaoka; Masahisa Ibuki, both of Izumisano, Japan

[73] Assignee: Fuji Oil Co., Ltd., Osaka, Japan

[21] Appl. No.: 09/000,254

[22] PCT Filed: Jun. 4, 1997

[86] PCT No.: PCT/JP97/01902

§ 371 Date: Jan. 30, 1998

§ 102(e) Date: Jan. 30, 1998

[87] PCT Pub. No.: WO97/46641

PCT Pub. Date: Dec. 11, 1997

[30] Foreign Application Priority Data

Jun. 4, 1996 [JP] Japan ..... 8-141498

[51] Int. Cl.[7] ..... C10M 105/38

[52] U.S. Cl. ..... 508/463; 435/134; 435/135; 435/198

[58] Field of Search ..... 508/463

[56] References Cited

U.S. PATENT DOCUMENTS

| | | | |
|---|---|---|---|
| 3,450,819 | 6/1969 | Babayan et al. | 424/307 |
| 4,247,471 | 1/1981 | Klein et al. | 426/610 |
| 4,832,975 | 5/1989 | Yang | 426/607 |
| 5,000,975 | 3/1991 | Tomarelli | 426/2 |
| 5,066,510 | 11/1991 | Ehrman et al. | 426/607 |
| 5,288,512 | 2/1994 | Seiden | 426/607 |
| 5,503,855 | 4/1996 | Hidaka et al. | 426/33 |
| 5,713,965 | 2/1998 | Foglia et al. | 508/463 |

FOREIGN PATENT DOCUMENTS

| | | |
|---|---|---|
| 4-314790A | 5/1992 | Japan . |
| 4-363351 | 12/1992 | Japan . |
| 5-209187 | 8/1993 | Japan . |
| 060-14710A | 1/1994 | Japan . |
| 071-179882A | 7/1995 | Japan . |
| 7-214118 | 8/1995 | Japan . |

*Primary Examiner*—Margaret Medley
*Attorney, Agent, or Firm*—Shinjyu An Intellectual Property Firm

[57] ABSTRACT

A biodegradable lubricant base oil of satisfactory low-temperature fluidity, oxidative stability and lubricity, and having a low cloud point, is disclosed. The lubricant base oil is manufactured by mixing and subjecting the following simultaneously to an ester-interchange reaction in the presence of an enzymatic catalyst: (A) 30 to 60% by weight of a fat/oil containing 20% by weight or more trans-isomeric fatty acids, 60% or more by weight mono-ene fatty acids having 16 or more carbons, and 12% or less by weight di-ene fatty acids having 16 or more carbons; (B) 5 to 35% by weight of a fat/oil wherein substantially none of the fatty acids is trans-isomeric, and including 60% or more by weight mono-ene fatty acids having 16 or more carbons, and 12% or less by weight di-ene fatty acids having 16 or more carbons; and (C) 15 to 45% by weight of either a fat/oil comprising 80% by weight or more medium-chain saturated fatty acids, or medium-chain fatty acids, or lower alcohol esters of medium-chain fatty acids.

8 Claims, No Drawings

BIODEGRADABLE LUBRICANT BASE OIL AND ITS MANUFACTURING PROCESS

This Application is a 371 of PCT/JP97/01902 filed on Jun. 4, 1997.

TECHNICAL FIELD

The present invention relates to lubricating oils suitable in rolling mill applications, in two- and four-cycle engine lubricating oil applications, and furthermore in cutting oil applications; in particular it relates to biodegradable lubricating oils having high oxidative stability, low-temperature fluidity and high lubricity.

BACKGROUND ART

Among properties sought-after in a lubricating oil, the performance characteristics of (1) high oxidative stability, (2) satisfactory fluidity at low temperatures, (3) high viscosity index and (4) satisfactory lubricity in load-carrying capacity, anti-wear capacity, etc., can be given.

Generally, mineral oils have been employed as oils in lubricants. In recent years, however, from an environmental preservation standpoint there have been calls centered in Europe for highly biodegradable oils, and the development of a base oil which replaces the poorly biodegradable mineral oils has been desired.

As highly biodegradable base oils there are vegetable oils (the biodegradation rate according to the CEC-L33-A-93 method is 90–100%) and polyolesters (ditto, 55–100%). Vegetable fatty oils possess the drawback of inferior oxidative stability. Nevertheless, vegetable fatty oils have advantages such as high viscosity indices, excellent lubricity in extreme pressure, low volatility and good compatibility with additives.

Accordingly, in recent years studies on improving the use of vegetable fatty oils in lubricant base oils have been made. For example, Pat. Laid-Open 209187, 1993 discloses a technology of improved cold resistance, i.e., low-temperature fluidity, by adding esters of polyglycerine fatty acid, esters of sucrose fatty acid, and lecithin to a liquid oil such as rapeseed oil. However, in the above-noted technology, because a liquid fat such as rapeseed oil is used, its oxidative stability is poor.

Further, Laid-Open Pats. 14710, 1994 and 179882, 1995 disclose a technology of improved low-temperature fluidity that introduces a medium-chain saturated fatty acid into a liquid fat such as rapeseed oil by ester interchange. However, due to the use of a fatty oil such as rapeseed oil that contains a large quantity of unsaturated fatty acid, the oxidative stability is not good (e.g., in Laid-Open Pat. 179882, 1995, the Ransmatt stability is in the range of 4 to 5 hours).

Meanwhile, there is also a technology that introduces a medium-chain saturated fatty acid into a hydrogenated coconut oil, palm kernel oil, etc. fatty oil whose unsaturated fatty acid content is scant (Laid-Open Pat. 314790, 1992). Nevertheless, although oxidative stability is improved with this technology, it turns out not to be satisfactory because solid fat is utilized and the cloud point is high (0° C. or more in the majority of instances). Therefore, in order to lower the cloud point, a large amount of medium-chain triglycerides (MCTS), which are expensive, is necessary.

Fatty oils which become solid at ordinary temperatures, such as the foregoing palm oil, beef tallow and hardened oil, that are to be raw materials are of comparatively good oxidative stability, but since their melting points are high, their low-temperature fluidity is poor. Meanwhile, wherein a fatty oil such as linseed oil and fish oil which contains many highly unsaturated fatty aids, or a fatty oil such as rapeseed oil and soybean oil which contains much linoelic acid, is utilized independently as a lubricating oil, it will be of comparatively good low-temperature fluidity, but the oxidative stability will be poor. As a fatty oil endowed concurrently with oxidative stability and low-temperature fluidity, medium-chain saturated fatty acid triglycerides can be given. However, wherein they are utilized independently, lubricity deteriorates, since compared with general vegetable oils (palm oil, rapeseed oil, etc.) the alkyl group is a short chain.

In other words, a lubricating oil in which vegetable oil is made the base, and which is a base oil concurrently endowed with oxidative stability and low-temperature fluidity, at present has not yet been sufficiently developed.

The object of the present invention is to develop a biodegradable lubricant base oil of good fluidity at low temperatures, of low cloud point, and furthermore of good oxidative stability and lubricity.

DISCLOSURE OF THE INVENTION

As the result of zealous investigation in order to solve the above-noted problems, the present inventors, by discovering that among fatty oils of high oleic acid content, a fatty oil in which the trans-acid is made constant and in which medium-chain saturated fatty acids of 6 to 12 carbons are located into glyceride positions 1 and 3, is of good low-temperature fluidity, low cloud point, suitable lubricity and good oxidative stability, brought the present invention to completion.

In other words, the present invention is a process for manufacturing a lubricant base oil, as well as a lubricant base oil obtained thereby, in which 30 to 60% by weight of a fatty oil among constituent fatty acids of which there is 20% by weight or more are trans-isomeric and 60% or more by weight of a mono-ene fatty acids having 16 or more carbons and 12% or less by weight di-ene fatty acids, 5 to 35% by weight of a fatty oil among constituent fatty acids of which there is 60% or more by weight mono-ene fatty acids having 16 or more carbons and 12% or less by weight of di-ene fatty acids and 15 to 45% by weight of either a fatty oil among constituent fatty acids of which there is 80% by weight or more of a medium-chain saturated fatty acid, or a medium-chain fatty acid or a lower alcohol ester thereof, are mixed and subjected to an ester interchange reaction.

The present invention further is a process for manufacturing a lubricant base oil, as well as a lubricant base oil obtained thereby, in which the above-noted fatty oil among constituent fatty acids of which there is 60% or more by weight of a mono-ene fatty acid having 16 or more carbons and 12% or less by weight of a di-ene fatty acid is a high-oleic sunflower oil.

The present invention moreover is a process for manufacturing a lubricant base oil, as well as a lubricant base oil obtained thereby, in which the above-noted fatty oil among constituent fatty acids of which there is 20% by weight or more of a trans-acid is a hardened palm fractionated oil.

The present invention is a process for manufacturing a lubricant base oil, as well as a lubricant base oil obtained thereby, in which the above-noted fatty oil among constituent fatty acids of which there is 80% by weight or more of a medium-chain saturated fatty acid is an MCT.

The present invention is a process for manufacturing a lubricant base oil, as well as a lubricant base oil obtained thereby, in which the above-noted ester interchange reaction is carried out utilizing a lipase having specificity to glyceride positions 1 and 3.

Most Preferable Form for Implementing the Present Invention

As a fatty oil among the constituent fatty acids of which there is 60% or more by weight of a mono-ene fatty acid having 16 or more carbons and 12% or less by weight of a di-ene fatty acid, high-oleic sunflower oil, hardened soybean fractionated oil and hardened rice bran oil can be given. Among these, high-oleic sunflower oil is especially preferable. If the said fatty oil is less than 5%, low-temperature fluidity worsens; if in excess of 35% by weight, oxidative stability worsens. Further, if the di-ene fatty acid surpasses 12% by weight, oxidative stability worsens.

Accordingly, fatty oils in which the di-ene fatty acid content is large, such as rapeseed oil and sunflower oil, are excluded.

As a fatty oil of 20% by weight or more trans-acid among its constituent fatty acids, hardened palm fractionated oil, hardened soybean fractionated oil and hardened fractionated rice bran oil can be given. If the fatty oil of 20% by weight or more trans-acid among its constituent fatty acids is less than 30% by weight oxidative stability worsens; if in excess of 60% by weight low-temperature fluidity worsens.

A medium-chain saturated fatty acid in the present invention means a saturated fatty acid of 6 to 12 carbons. The number of carbons of the medium-chain fatty acid is preferably 8 to 10. A fatty oil which can be employed that contains 80% or more by weight medium-chain saturated fatty acid among its constituent fatty acids is a commercially available MCT. If the fatty oil that contains 80% or more by weight medium-chain saturated fatty acid is less than 15% by weight, there will be problems with the low-temperature fluidity obtained; and if in excess of 45% by weight, the lubricity will be degraded.

Mixing the foregoing fatty oils, an ester interchange reaction is carried out. The composition of the mixed oil is one which contains approximately 40–58% by weight mono-ene fatty acid, 10–20% by weight trans-acid and 20 to 40% by weight medium-chain saturated fatty acid. Due to the ester interchange reaction, the fatty oil submitted to the reaction has a low-temperature flow point and a low cloud point which could not be obtained only by simply mixing. This is because it is created from a mixed-acid group triglyceride into which medium-chain saturated fatty acids have been introduced. Accordingly, other than being introduced in the form of a triglyceride, the medium-chain saturated fatty acid can by introduced in the form of a lower alcohol ester of a medium-chain saturated fatty acid or a free medium-chain fatty acid.

It is preferable to carry out the ester interchange with lipase having specificity to glyceride positions 1 and 3 as a catalyst. This is because random ester interchange easily invites elevation of cloud point, making necessary a post-reaction step in which the high melting-point component is removed fractionally.

It is possible to utilize a publicly known lipase having specificity to glyceride positions 1 and 3. This may be exemplified, for example, by those that are micro-organism derived, from Rhizopus delemar, Mucor miehei and Alcaligenes spp., etc.; and by those that are vegetable-oil derived, from soybean, rice bran and castor seed, etc. Other than such lipases as animal pancreatic lipase, it is also possible to utilize a fixed lipase obtained by ordinary adsorption, ionic or covalent bonding, or inclusion methods. Further, it is also suitable to utilize microorganisms such as fungi, yeasts and bacteria, that are capable of producing said lipase.

The synthetic fatty oil can be used as is as a base oil in a lubricant. Depending on the stock oil, it may be suitable to carry out purifying treatments to remove acid, to decolor or to remove smell. Further, as needed, additives such as rust preventives, extreme-pressure agents, flow point lowering agents, oxidation preventives, defoaming agents, metal cleaners and anti-abrasion agents can be added; and it also can be used as a lubricant blended with ester series lubricating oils, mineral oils, or the like.

EXPERIMENTS

Embodiment 1

| | |
|---|---|
| Hardened palm fractionated oil | 54% by weight |
| High-oleic sunflower oil | 6% by weight |
| MCT | 40% by weight |

Utilizing 1, 3 specific lipase (derived from Rhizopus niveus) an ester interchange reaction was carried out on the above-noted oil blend. As to the hardened palm fractionated oil, the low-melting point part of an oil in which the palm olein was hardened and fractionated was utilized (33% by weight trans-acid, 64% by weight mono-ene fatty acid of 16 or more carbons, 4.3% di-ene fatty acid of 16 or more carbons). The mono-ene fatty acid content in the high-oleic sunflower oil was 81% by weight, and the di-ene fatty acid of 16 or more carbons was 8.8% by weight. The MCT utilized was one having a C8=65% and C10=35% composition.

Embodiment 2

| | |
|---|---|
| Hardened palm fractionated oil | 50% by weight |
| High-oleic sunflower oil | 30% by weight |
| MCT | 20% by weight |

Utilizing 1, 3 specific lipase (derived from Rhizopus niveus) an ester interchange reaction was carried out on the above-noted blended oil.

Embodiment 3

| | |
|---|---|
| Hardened palm fractionated oil | 40% by weight |
| High-oleic sunflower oil | 20% by weight |
| MCT | 40% by weight |

Utilizing 1, 3 specific lipase (derived from Rhizopus niveus) an ester interchange reaction was carried out on the above-noted blended oil. The hardened soybean fractionated oil utilized was one having a 35% by weight trans-acid, 77% by weight mono-ene fatty acid of 16 or more carbons, and 7.5% by weight di-ene fatty acid of 16 or more carbons composition.

Comparative Example 1

Oil blend of Example 1 (ester interchange not carried out).

Comparative Example 2

Oil blend of Example 2 (ester interchange not carried out).

Comparative Example 3

Oil blend of Example 3 (ester interchange not carried out).

Comparative Example 4

| | |
|---|---|
| Hardened palm fractionated oil | 67.5% by weight |
| High-oleic sunflower oil | 7.5% by weight |
| MCT | 25% by weight |

Utilizing 1, 3 specific lipase (derived from Rhizopus niveus) an ester interchange reaction was carried out on the above-noted blended oil.

Comparative Example 5

| | |
|---|---|
| Hardened palm fractionated oil | 20.0% by weight |
| High-oleic sunflower oil | 60.0% by weight |
| MCT | 20.0% by weight |

Utilizing 1, 3 specific lipase (derived from Rhizopus niveus) an ester interchange reaction was carried out on the above-noted blended oil.

Comparative Example 6

| | |
|---|---|
| Hardened palm fractionated oil | 40.0% by weight |
| High-oleic sunflower oil | 30.0% by weight |
| MCT | 30.0% by weight |

Utilizing 1, 3 specific lipase (derived from Rhizopus niveus) an ester interchange reaction was carried out on the above-noted blended oil.

(Experimental Results)

The fatty oil compositions obtained in the embodiments and comparative examples are shown in Table 1.

TABLE 1

| | % Mono-ene Fatty Acid Among Fatty Acid Constituents | % Trans-Acid Among Fatty Acid Constituents |
|---|---|---|
| Embodiment 1 | 43.8 | 18.0 |
| Embodiment 2 | 56.1 | 16.7 |
| Embodiment 3 | 45.2 | 14.1 |
| Compar. Ex. 1 | 43.8 | 18.0 |
| Compar. Ex. 2 | 56.1 | 16.7 |
| Compar. Ex. 3 | 45.2 | 14.1 |
| Compar. Ex. 4 | 49.2 | 22.5 |

TABLE 1-continued

| | % Mono-ene Fatty Acid Among Fatty Acid Constituents | % Trans-Acid Among Fatty Acid Constituents |
|---|---|---|
| Compar. Ex. 5 | 60.8 | 6.7 |
| Compar. Ex. 6 | 36.7 | 13.3 |

In order to conduct an evaluation of the fatty oils of the present invention, the measurements below were carried out. The results are shown in Table 2.

(1) Pour point and cloud point: carried out by an automatic pour point/cloud point measuring apparatus (Tanaka Scientific Instruments mfr.) on the basis of JIS K2269.

(2) Oxidative stability (RBOT oxidative stability): carried out by a rotary-bomb type oxidative stability testing appliance (Rigou Co. Mfr.) on the basis of JIS K2514. Rancimat stability: measured by a measuring device of Switzerland Metrohm Co. mfr.

(3) Viscosity index: carried out on the basis of ASTM D2270-64.

TABLE 2

| | Pour Point | Cloud Point | Rancimat Stability (hr) | RBOT Oxidative Stability (min) | Viscosity Index |
|---|---|---|---|---|---|
| Embodiment 1 | −5.0 | −3.1 | 45.3 | 63 | 148 |
| Embodiment 2 | −6.0 | −3.2 | 31.4 | 34 | 150 |
| Embodiment 3 | −2.0 | −4.0 | 37.0 | 57 | 155 |
| Compar. Ex. 1 | −1.0 | 22.9 | 49.6 | 85 | 154 |
| Compar. Ex. 2 | −1.0 | 15.7 | 35.3 | 60 | 152 |
| Compar. Ex. 3 | 2.0 | 12.1 | 40.3 | 71 | 156 |
| Compar. Ex. 4 | −1.0 | 10.5 | 36.2 | 38 | 148 |
| Compar. Ex. 5 | −14.0 | −4.0 | 10.3 | 16 | 152 |
| Compar. Ex. 6 | 5.07 | 15.1 | 22.5 | 21 | 152 |
| Rapeseed Oil | −18.0 | −12.3 | 3.2 | 11 | 148 |
| High-Oleic Sunflower Oil | −9.0 | 40.0 | 9.0 | 15 | 152 |

The embodiments, being of low pour points and cloud points, moreover of high oxidative stability, proved to be satisfactory. The oxidative stability is extremely high compared with rapeseed oil and high-oleic sunflower oil.

Comparative examples 1 to 3 turned out to have high flow points and cloud points because ester interchange was not carried out. Further, comparative example 4 is of good stability since the trans-acid is plentiful, but the pour point and cloud point turned out to be high. Comparative example 5 is of poor stability since the trans-acid is scant and the mono-ene fatty acid is plentiful. Comparative example 6 turned out to be of high flow point and cloud point since the mono-ene fatty acid was scarce.

INDUSTRIAL APPLICABILITY

According to the foregoing, a lubricant base oil manufacturing process in connection with the present invention, as well as a lubricant base oil obtained thereby, are a method of introducing medium-chain saturated fatty acids of 6 to 12 carbons into the 1, 3 positions of glyceride in vegetable fatty oils containing many mono-ene fatty acids as well as vegetable oils of 20% or more trans-acid content among the constituent fatty acids, and a lubricant base oil obtained thereby, which can provide good oxidative stability, good low-temperature fluidity and a low cloud point.

What is claimed is:

1. A process for manufacturing a biodegradable lubricant base oil, characterized in that the following (A), (B) and (C) are mixed and subjected simultaneously to an ester interchange reaction in the presence of an enzymatic catalyst, wherein the enzymatic catalyst is a lipase having specificity to glyceride positions 1 and 3:

(A) 30 to 60% by weight of a fatty oil comprising
20% by weight or more trans-isomeric tatty acids,
60% or more by weight mono-ene tatty acids having 16 or more carbons, and
12% or less by weight di-ene fatty acids having 16 or more carbons;

(B) 5 to 35% by weight of a fatty oil consisting of
60% or more by weight mono-ene fatty acids having 16 or more carbons, and
12% or less by weight di-ene fatty acids having 16 or more carbons,
with the proviso that no fatty acids in (B) is trans-isomeric; and (C) 15 to 45% by weight of one of
a fatty oil comprising 80% by weight or more medium-chain saturated fatty acids,
medium-chain fatty acids, and
lower alcohol esters of medium-chain fatty acids.

2. A process for manufacturing a biodegradable lubricant base oil as set forth in claim 1, wherein (A) is hardened palm fractionated oil.

3. A process for manufacturing a biodegradable lubricant base oil as set forth in claim 1, wherein (B) is high-oleic sunflower oil.

4. A process for manufacturing a biodegradable lubricant base oil as set forth in claim 1, wherein (C) is a medium-chain triglyceride.

5. A biodegradable lubricant base oil produced by mixing and subjecting simultaneously to an ester interchange reaction in the presence of an enzymatic catalyst wherein the enzymatic catalyst is a lipase having specificity to glyceride positions 1 and 3, the following (A), (B) and (C);

(A) 30 to 60% by weight of a fatty oil comprising
20% by weight or more trans-isomeric fatty acids,
60% or more by weight mono-ene fatty acids having 16 or more carbons, and
12% or less by weight di-ene fatty acids having 16 or more carbons;

(B) 5 to 35% by weight of a fatty oil consisting of
60% or more by weight mono-ene fatty acids having 16 or more carbons, and
12% or less by weight di-ene fatty acids having 16 or more carbons,
with the priviso that no fatty acids in (B) is trans-isomeric; and (C) 15 to 45% by weight of one of
a fatty oil comprising 80% by weight or more medium-chain saturated fatty acids,
medium-chain fatty acids, and
lower alcohol esters of medium-chain fatty acids.

6. A biodegradable lubricant base oil as set forth in claim 5, wherein (A) is hardened palm fractionated oil.

7. A biodegradable lubricant base oil as set forth in claim 5, wherein (B) is high-oleic sunflower oil.

8. A biodegradable lubricant base oil as set forth in claim 5, wherein (C) is a medium-chain triglyceride.

* * * * *